United States Patent [19]

To

[11] Patent Number: 4,898,060

[45] Date of Patent: Feb. 6, 1990

[54] MUSICAL ADAPTER FOR NURSING BOTTLE

[76] Inventor: Ping K. To, 13/F., Flat A, No. 6, Centre Street, Hong Kong, Hong Kong

[21] Appl. No.: 278,365

[22] Filed: Dec. 1, 1988

[51] Int. Cl.[4] ..... G10F 1/06

[52] U.S. Cl. ..... 84/95.2; 446/227; 446/302; 215/11.1

[58] Field of Search ..... 84/1.01, 1.18, 94.1, 84/94.2, 95.1, 95.2; 446/227, 229, 302, 484; 215/11.1, 11.2, 11.3, 11.4, 11.5, 11.6, 100 R

[56] References Cited

U.S. PATENT DOCUMENTS

| | | | |
|---|---|---|---|
| 2,929,290 | 3/1960 | Smith | 84/95.2 |
| 3,627,161 | 12/1971 | Wergeland | 215/11.6 |
| 4,537,109 | 8/1985 | Sakurai | 84/1.18 |
| 4,554,919 | 11/1985 | Hurbert | 128/360 |
| 4,607,747 | 8/1986 | Steiner | 84/94.2 |
| 4,628,791 | 12/1986 | Phipps | 84/94.2 |
| 4,678,093 | 7/1987 | Allen | 215/11.1 |
| 4,756,222 | 7/1988 | Armato | 84/1.01 |
| 4,765,465 | 8/1988 | Yamada et al. | 215/100 R |

*Primary Examiner*—L. T. Hix
*Assistant Examiner*—Brian W. Brown
*Attorney, Agent, or Firm*—Wenderoth, Lind & Ponack

[57] ABSTRACT

A musical adapter for use with a nursing bottle comprising an upper portion and a lower portion, which two portions being detachably joined together to form a single body. An electronic muscial device of integrated circuits is disposed in the interior space of the lower portion and is capable of producing a melodious tune upon the bottle being lifted or tipped up.

4 Claims, 3 Drawing Sheets

MUSICAL ADAPTER FOR NURSING BOTTLE

BACKGROUND OF THE INVENTION

The present invention relates to a musical adapter for use with a liquid container and, more particularly to an electronic musical adapter which fits round the bottom of a container, such as a nursing bottle, a tea cup or a pot and which together with the container forms a single body, whereby when a user tips up the liquid container with its mouth facing downwardly at a certain degrees, the electronic musical device inside the adapter will produce a melodious tune to help children to finish up their drink willingly.

Various types of infant articles and toys, such as musical boxes with animal head shape, dolls and hand bells, have been fitted with various types of electronic or mechanical musical devices. These devices however are all combined with the articles and together form into single bodies, which thus can not be detached and also can not be removed for other uses.

SUMMARY OF THE INVENTION

It is an object of the present invention to provide a simple and novel electronic musical adapter for use with a liquid container, which adapter is detachably attached to the container, particularly to the bottom of a nursing bottle and together forms with the nursing bottle into a single body, and which, when the container mouth is tipped up downwardly in a certain degree for drinking up, for instance, milk contained therein, is capable of producing a musical tune thereby enabling children to drink up milk willingly and to keep on playing with the container even after drinking.

It is a further object of the present invention to provide an electronic musical adapter which can be attached to and removed out from the bottom of a liquid container easily thereby to avoid any interference with the washing of the container.

It is yet another object of the present invention to provide an electronic musical adapter capable of fitting round various types of liquid containers, such as bottles and cups, having a matched exterior diameter, and even round other toys or articles.

BRIEF DESCRIPTION OF THE DRAWINGS

A preferred embodiment of the present invention will now be described with reference to the examples thereof as illustrated in the accompanying drawings, in which.

DETAILED DESCRIPTION OF PREFERRED EMBODIMENTS

Figure 1:
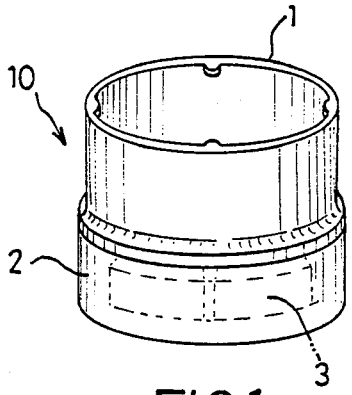
FIG. 1 is a perspective view of the electronic musical adapter for use with a liquid container of the present invention.

FIG. 1 shows a perspective view of an embodiment of the musical adapter for use with a nursing bottle of the present invention, in which the musical adapter 10 comprises an upper cup-like portion 1 in the shape of a cylinder or of any other suitable shape, a lower cylindrical base portion 2 closed on the bottom and detachably fitted round the lower end of the upper portion 1, and an electronic musical device 3 mounted in the interior of the base portion 2.

Figure 2:
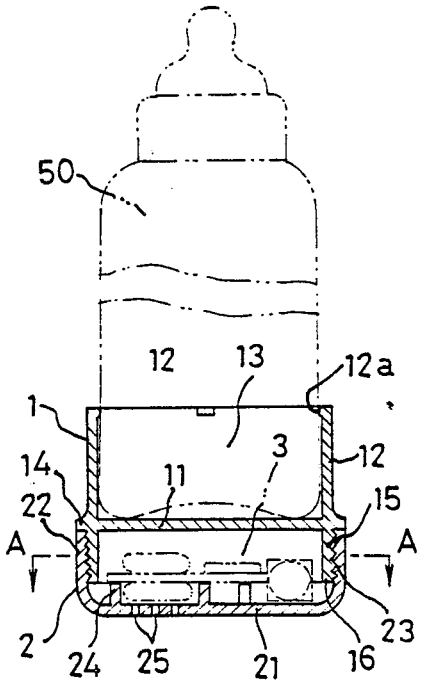
FIG. 2 is a longitudinal section view of the musical adapter as shown in FIG. 1.

The upper portion 1, as shown in FIG. 2, is a cylindrical bottomed body having at the lower part a bottom wall 11 and the perimeter forming a cylinder-shaped circumferential wall 12. A hollow space 13 defined by the circumferential wall 12 and the bottom wall 11 is provided for fitting therein of a liquid container 50, such as a nursing bottle. There is formed on the place of the bottom wall 11 where the circumferential wall 12 is located a ring-shaped flange 14, and at the lower part of the bottom wall 11 is also a cylindrical joint end 16 formed by the perimeter extending downwardly from the circumferential wall 12 and being provided with attachment means such as male thread 15 for joining of the base portion 2. It is next preferable that the circumferential wall 12 is provided on the interior wall thereof with a plurality of frictional projections **12*a* for snap-engaging of the liquid container; however, it will also do if there is a wall 12** without such a frictional projection.

Figure 3:
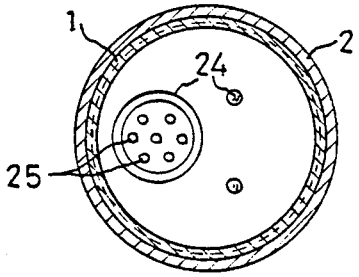
FIG. 3 is a cross section view taken along the line A—A in FIG. 2 of the musical adapter.

Referring now to FIGS. 2 and 3, the base portion 2 as shown is a shallow bowl-shaped body having a bottom wall 21 and a circumferential wall 22, the circumferential wall 22 of which is provided with a female thread 23 capable of engaging with the aforesaid male thread 15 thereby forming a single body with the upper portion 1. On the interior of the bottom wall 21 there is formed supporting means 24 for mounting of various components of the electronic musical device 3, whereas on the bottom wall 21 at the place where the following buzzer is to be located is next formed a plurality of sound holes 25 for transmitting out the music. However, these sound holes 25 are not necessarily restricted to the bottom wall 21, as the sound holes may be formed elsewhere on the base portion.

Figure 4:
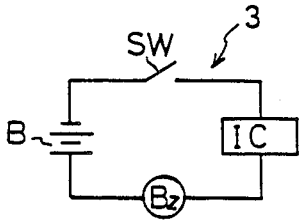
FIG. 4 is a the circuit diagram of the musical adapter.

The electronic musical device 3, as indicated in the circuit diagram of FIG. 4, includes a switch SW, an electronic musical apparatus IC, a buzzer BZ and a cell battery B electrically connected in series with each other. In order to adapt the circuit for mass production it is preferable that the circuit be made into a printed circuit board.

In the musical adapter 10 of the present invention, the electronic musical device 3 is first disposed in the base portion 2 and this base portion 2 is next joined to the upper portion 1 by the female thread 23 being threadingly engaged to the male thread 15 and thus forms together with the upper portion 1 a single body.

The upper portion 1 and the lower portion 2 are generally formed by molding from a synthetic resin. Besides, for the aforesaid switch SW there may preferably be used a mercury switch, a microswitch, a magnetic spring leaf switch, or a light sensitive switch, the function of which will be described later.

Figure 5:
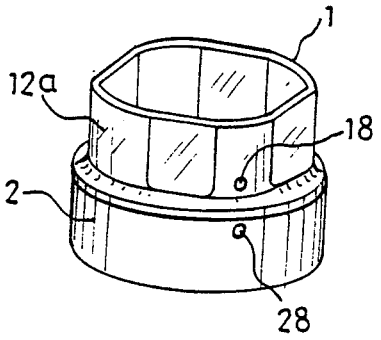
FIG. 5 is a perspective view of another embodiment of the construction of the musical adapter.
Figure 6:
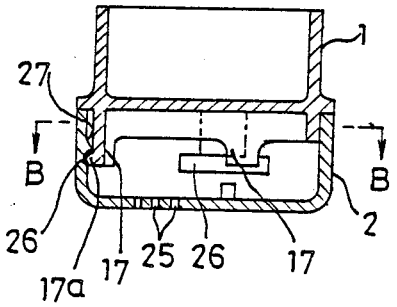
FIG. 6 is a longitudinal section view of the musical adapter as shown in FIG. 5.
Figure 7:
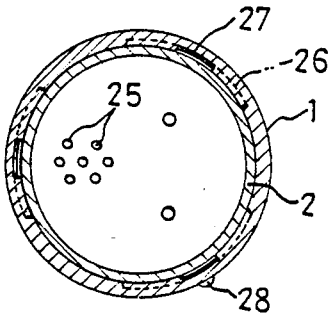
FIG. 7 is a cross section view taken along the line B—B in FIG. 6 of the musical adapter.

FIGS. 5 through 7 illustrate another embodiment of the musical adapter for a nursing bottle in accordance to the present invention, that is basically the same in composition as the first embodiment. Hence, the same reference numerals will be used to designate the same parts or the equivalents and for which description will be omitted. In the present embodiment, the upper circumferential wall 12*a* of the upper portion 1 is formed similar to an octogonal cylinder in shape in order to suit the liquid container of generally similar shape, while it being also suitable for any rounded container. The joint end 16 has a relatively shorter circumferential wall than the first embodiment and at the lower end of which is formed a plurality (in the present embodiment there are three) of equi-spaced downwardly extending projecting sheets 17. At the lower end outer circumference of each of these projecting sheets 17 there is a circumferentially extending engaging bar 17*a*. In addition, there is formed on the interior wall face of the base portion 2 a plurality of equispaced elongate channels 26 (in the present embodiment there are three) arranged circumferentially. Each of these channels 26 is in turn provided in the upper central portion with a guide groove 27 being slightly longer than the engaging bar 17*a*. Next, on the outer circumference of the upper portion 1 at the place where the flange 14 is located and at the upper portion of one of the projecting sheets 17 is a positioning ball 18. A positioning ball 28 is similarly provided on the upper part of the outer circumference of the base portion 2 at a location on the outer wall of the upper central portion of one of the guide grooves 27. When the upper portion 1 and the base portion 2 are to be joined together, the positioning balls 18 and 28 on the two portions must first be aligned in a vertical column, and as the joint end 16 of the upper portion 1 is fitted through the guide groove 27 on the base portion 2 in the latter by means of the projecting sheets 17, the engaging bar 17*a* is then engaged in the channel 26. Then, when the base portion 2 and the upper portion 1 are turned against each other in a certain degree so that the positioning balls 18 and 28 turn away from alignment the upper portion 1 and the base portion 2 join together to form a single body and will not separate out. Next, when the base portion 2 of the musical adapter is to be removed, the base portion 2 or the upper portion 1 is turned to align the two positioning balls 18 and 28 in a vertical line and the base portion is then pulled downwardly out. Following this performance, the base portion 2 becomes separated from the upper portion 1 and during that time a battery cell may be replaced.

Figure 8:
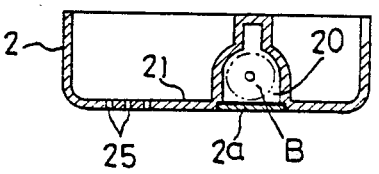
FIG. 8 is a longitudinal section view of the lower portion of still another example of the construction of the musical adapter.

In order to replace the battery cell directly from the bottom side of the base portion 2 and without detaching the base portion 2 from the upper portion 1, there may be formed on the bottom face of the base portion 2 a downwardly open battery chamber 20 having a lid 2*a* to open and close the opening, as shown in FIG. 8.

Figure 9:
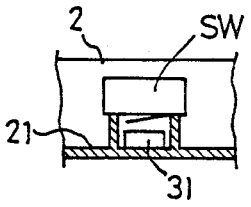
FIGS. 9 and 10 are longitudinal section views of the lower portion of the musical adapter showing the use of different switches.
Figure 10:
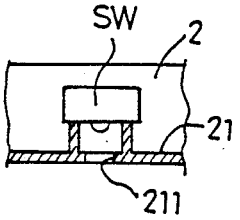

For the switch SW in the aforesaid circuit, in order that the circuit is energized when the liquid container is lifted and tipped up, besides a mercury switch that can be used, it is also possible to utilize a microswitch, or a magnetic spring leaf switch. If a microswitch is used as shown in FIG. 9, it will be preferable that a chamber 20 is formed inside the base portion 2 and the chamber includes thereinside a weight 21 which is some distance away from and opposite the microswitch arranged on the inside upper part of the chamber. When the adapter of the present invention is tipped up along with the liquid container, the weight 31 slides down and touches the switch SW thereby energizing the switch. If however a magnetic spring leaf switch is used, the condition will be just like that as with the use of a microswitch, only that instead of the weight 31 a magnet is used. Again, if a light sensitive switch is used, then, there must be formed on the base portion 2 a penetration hole 211 for light to pass through in order that the switch is energized by the light.

Figure 11:
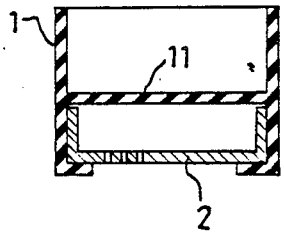
FIG. 11 is a longitudinal section view of the musical adapter formed from a soft material.

In a further embodiment, a soft synthetic resin or rubber may be employed in the making of the upper portion 1 into a shape as shown in FIG. 11, while the base portion 2 is thus mounted in the hollow cavity on the bottom of the upper portion 1.

Figure 12:
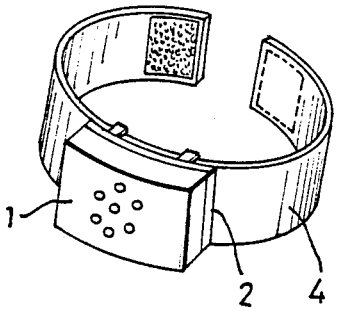
FIG. 12 is a perspective view of the musical adapter constructed in a boxlike shape capable of being attached to a liquid container with a strap.

In still another embodiment, the musical adapter 10 of the present invention may be made, as shown in FIG. 12, into a boxtype body 2 of a rectangular shape only or of a variety of shapes and in which there is no upper portion 1. The boxtype body 2 includes therein the foregoing electronic musical device 3, while on the back side of which is a tying strap 4 capable of fastening to a liquid container thereby achieving the same effectiveness.

Figure 13:
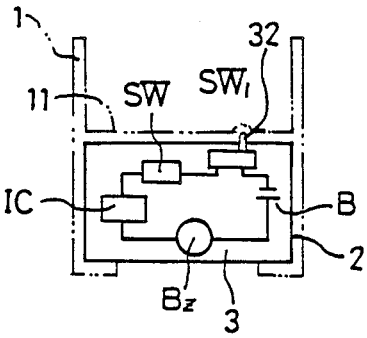
FIG. 13 is a sketch diagram of the musical adapter showing a switch being additionally added to the circuit to form a dual switch.

In yet still another embodiment, the circuit of the electronic musical device 3 can be electrically connected to another switch SW' in a series to constitute a dual switch apparatus. The touch button part 32 of this switch extends outwardly from the bottom wall 11 of the soft upper portion 1 as shown in FIG. 13. Hence, only when a container is engaged in the upper portion 1 and the bottom of the container touches and presses against the said touch button part, will the circuit become energized. As such, as long as a container has not been mounted, this musical adapter 10, even if loaded with a cell battery B, will not cause the switch SW to be energized and play a non-stop musical tune because of being transported, moved, or placed upside-down.

Owing to the construction, as alluded to hereinbefore, in the musical device of the present invention, one needs only to mount the bottom of a liquid container, such as a nursing bottle, in the hollow cavity of the upper portion, whereby the container joins with the electronic musical device to form into a single body. When the child uses the bottle for a drink, the device will produce a melodious tune, which not only pleases and encourages the child to finish up its drinking, but also has the effect of shaping its spirit with music. Furthermore, since the adapter can be easily removed from the liquid container at any time facilitating the cleansing of the bottle, the musical adapter of the invention is thus of a novel and practically useful form.

I claim:

1. An electronic musical adaptor for use with a nursing bottle, a cup, or a liquid container, said adaptor comprising:

a hard injection molded synthetic resin cup-shaped body having an upper portion and a lower portion, a substantially cylindrical wall defining a hollow cavity in said upper portion, means on said cylindrical wall for releasably retaining a liquid container in said hollow cavity, a downwardly open substantially cylindrical skirt on said lower portion of said cup-shaped body, means on said cylindrical skirt for frictionally detachably engaging said cup-shaped body with a bowl-shaped base member;

a bowl-shaped base member having an upwardly extending circumferential wall detachably engaged with said frictional engaging means of said cup-shaped body, said circumferential wall of said bowl-shaped base member jointly defining a space with said cylindrical skirt of said cup-shaped body, and a plurality of through sound holes defined in said bowl-shaped base member for causing sound produced within said space to be transmitted out of said bowl-shaped base member; and an electronic musical IC device attached to said bowl-shaped base member and received within said space, switch means on said musical IC device for turning on said IC device for producing a sound responsive to tilting of said IC device when said electronic musical adaptor is picked up by a user.

2. A device as in claim 1, wherein said frictional engaging means of said cup-shaped body includes first threads defined in said substantially cylindrical wall, second threads are defined in said circumferential wall of said bowl-shaped base member, and said first and second threads are mating male and female threads.

3. A device as in claim 1, wherein said frictional engaging means of said cup-shaped body includes one of a plurality of connecting sheets having engaging bars and a plurality of mating L-shaped channels for receiving engaging bars, and said bowl-shaped base member has one of a plurality of mating L-shaped channels and a plurality of mating connecting sheets having engaging bars for frictionally detachably engaging said cup-shaped body and said bowl-shaped base.

4. A device as in claim 1, wherein each one of said cup-shaped body and bowl-shaped base has respective positioning protrusions or marks on an outer surface thereof for positioning alignment during engagement.

* * * * *